US009272285B2

(12) United States Patent
Wu

(10) Patent No.: US 9,272,285 B2
(45) Date of Patent: Mar. 1, 2016

(54) EMULSIFICATION GRINDER

(71) Applicant: Chin-Chu Wu, New Taipei (TW)

(72) Inventor: Chin-Chu Wu, New Taipei (TW)

( * ) Notice: Subject to any disclaimer, the term of this patent is extended or adjusted under 35 U.S.C. 154(b) by 119 days.

(21) Appl. No.: 14/265,335

(22) Filed: Apr. 29, 2014

(65) Prior Publication Data

US 2015/0306603 A1 Oct. 29, 2015

(51) Int. Cl.

| | |
|---|---|
| ***B02C 7/12*** | (2006.01) |
| ***B02C 7/02*** | (2006.01) |
| ***B02C 7/04*** | (2006.01) |
| ***D21D 1/30*** | (2006.01) |

(52) U.S. Cl.

CPC ... *B02C 7/02* (2013.01); *B02C 7/04* (2013.01); *D21D 1/30* (2013.01); *D21D 1/303* (2013.01); *B02C 7/12* (2013.01); *D21D 1/306* (2013.01)

(58) Field of Classification Search

CPC ..... B02C 7/02; B02C 7/04; B02C 7/08; B02C 7/12

USPC ..... 241/261.2, 261.3, 245, 46.02, 46.06, 241/253, 257.1

See application file for complete search history.

(56) References Cited

U.S. PATENT DOCUMENTS

| | | | | | |
|---|---|---|---|---|---|
| 5,586,729 | A * | 12/1996 | Davenport | B02C 7/04 | 241/21 |
| 6,053,440 | A * | 4/2000 | LaRiviere | D21D 1/303 | 241/261.2 |
| 6,227,467 | B1 * | 5/2001 | Davenport | B02C 7/04 | 241/15 |
| 6,250,573 | B1 * | 6/2001 | Kriebel | B01F 7/00758 | 241/17 |
| RE39,688 | E * | 6/2007 | LaRiviere | D21D 1/303 | 241/261.2 |
| 7,694,902 | B2 * | 4/2010 | Demler | B02C 7/14 | 241/21 |
| 2004/0155127 | A1 * | 8/2004 | Kapper | B02C 7/04 | 241/30 |

* cited by examiner

*Primary Examiner* — Faye Francis

(57) ABSTRACT

The emulsification grinder includes a feeder module, a grinding wheel assembly and a driver module. The grinding wheel assembly separately connects the feeder module and driver module and includes an upper grinding wheel, a lower grinding wheel and a turntable. The upper grinding wheel is radially formed with knives. The lower grinding wheel corresponds to the upper grinding wheel at an interval and has a receiving room and knives. The turntable is received in the receiving room.

7 Claims, 4 Drawing Sheets

EMULSIFICATION GRINDER

BACKGROUND OF THE INVENTION

1. Technical Field

The invention relates to grinders, particularly to grinders which can grind fluid material into emulsion.

2. Related Art

To satisfy demands of users, the particle size of ground material becomes smaller and smaller. For example, in cosmetics, the particles must be ground to be the finest and emulsifiable so as to be easily absorbed by skin without harm. Thus the grinders must be very precision.

To achieve such grinding precision, conventional grinders add multiple knives, which are axially connected in series. By means of the centrifugal effect of rotation, the material to be ground are flung to the knives and then cut and ground. The axially arranged knives, however, cannot be reduced in volume. This will cause a problem of space utilization. Furthermore, because the material is flung by the centrifugal force, but the centrifugal force is hard to be controlled, the material is hard to be equably flung to the knives and to be equably ground. Finally, the grinding effect cannot satisfy the demand.

U.S. Pat. No. 6,250,573 provides a process and device for the dispersion of a fibrous paper material. '573 uses a gap between the teeth 7, 9 on the upper and lower grinding wheel to grind the material between the teeth. Although the teeth 7, 9 are radially arranged on the wheels to reduce its volume, the material flung by the turntable 5, especially liquid materials, tend to flow back due to the resistance of the teeth. The flow-back material will further resist the newly input materials. This causes a serious problem of material flow and grinding efficiency. This problem will become more serious if the material is syrupy.

SUMMARY OF THE INVENTION

An object of the invention is to provide an emulsification grinder, which can equably and smoothly grind the material without resistance.

An object of the invention is to provide an emulsification grinder, whose volume can be effectively reduced.

To accomplish the above objects, the emulsification grinder of the invention includes a feeder module, a grinding wheel assembly and a driver module. The grinding wheel assembly separately connects the feeder module and driver module and includes an upper grinding wheel, a lower grinding wheel and a turntable. The upper grinding wheel is radially formed with knives. The lower grinding wheel corresponds to the upper grinding wheel at an interval and has a receiving room and knives. The turntable is received in the receiving room.

The invention pushes the fluid material to the gap between the upper and lower grinding wheels through the rotation of the lower grinding wheel. The material radially flows and is cut and ground by the knives. The manner of the invention is different from '573 and the material will not flow back to cause resistance.

The invention reduces the gap between the grinding wheels to be a minimum status so that the cutting and grinding effect can be optimal. Meanwhile, the troughs on the bars can push the material to flow. Because the bars is received by the annular recession, the gap can be further reduced.

DETAILED DESCRIPTION OF THE INVENTION

Figure 1:
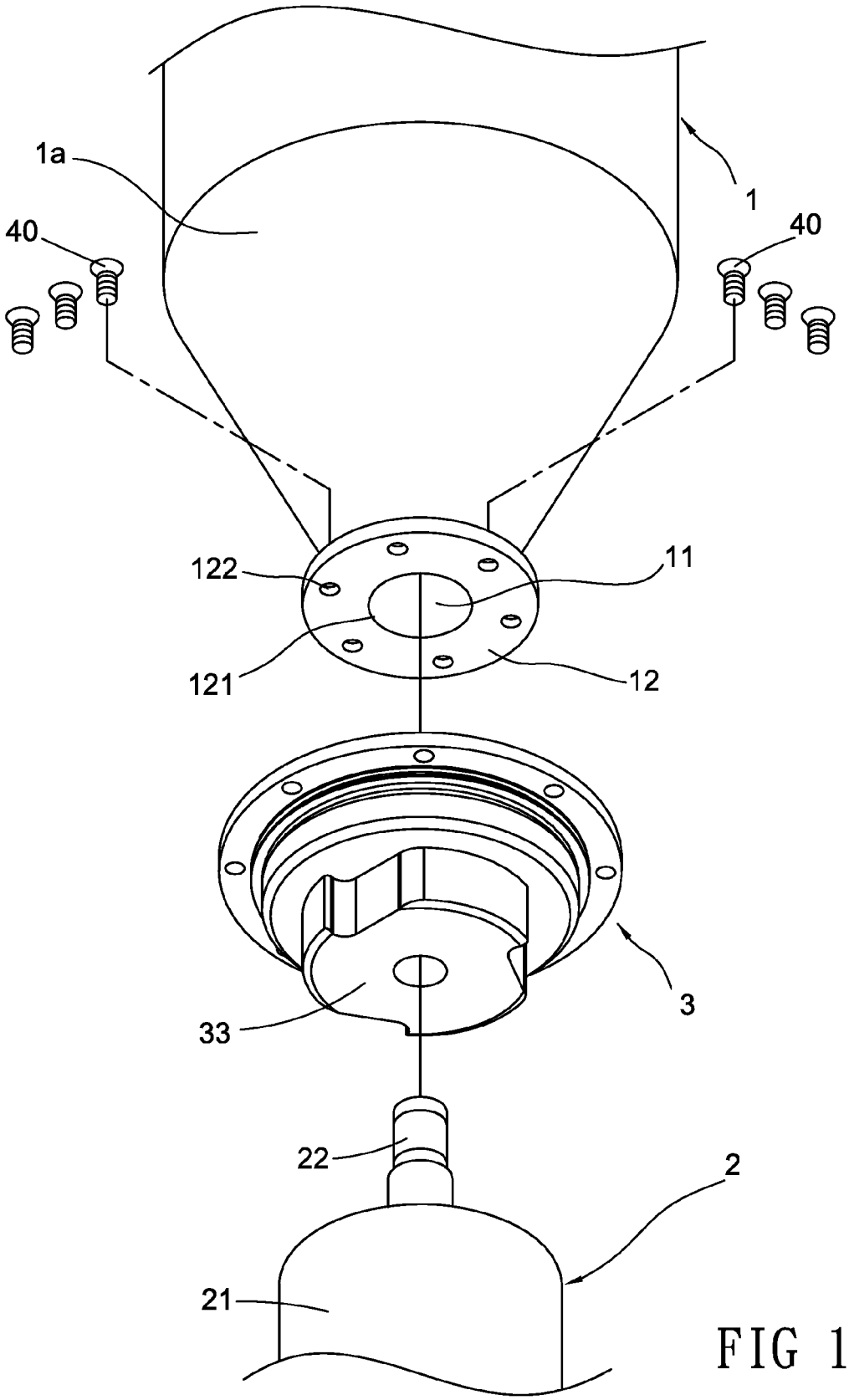
FIG. 1 is an exploded view of the invention.

Please refer to FIG. 1. The emulsification grinder of the invention includes a feeder module 1, a grinding wheel assembly 3 and a driver module 2. The grinding wheel assembly 3 separately connects the feeder module 1 and the driver module 2. The feeder module 1 is a funneled cylinder 1*a*. A cylindrical end of the cylinder 1*a* is an orifice 11. An edge of the orifice 11 is provided with a connecting disk 12 for joining the grinding wheel assembly 3. The center of the connecting disk 12 is formed with a through hole 121 corresponding to the orifice 11 in position. The connecting disk 12 is formed with fixing holes 122 for being passed by fasteners 40 to join the feeder module 1 to the grinding wheel assembly 3. In this embodiment, the fasteners 40 are bolts. The driver module 2 connects to another end of the grinding wheel assembly 3 for driving the grinding wheel assembly 3 to rotate. The driver module 2 includes a motor 21 with a spindle 22. The spindle 22 passes through the grinding wheel assembly 3 so that the motor 2 can rotate the grinding wheel assembly 3 through the spindle 22.

Figure 2:
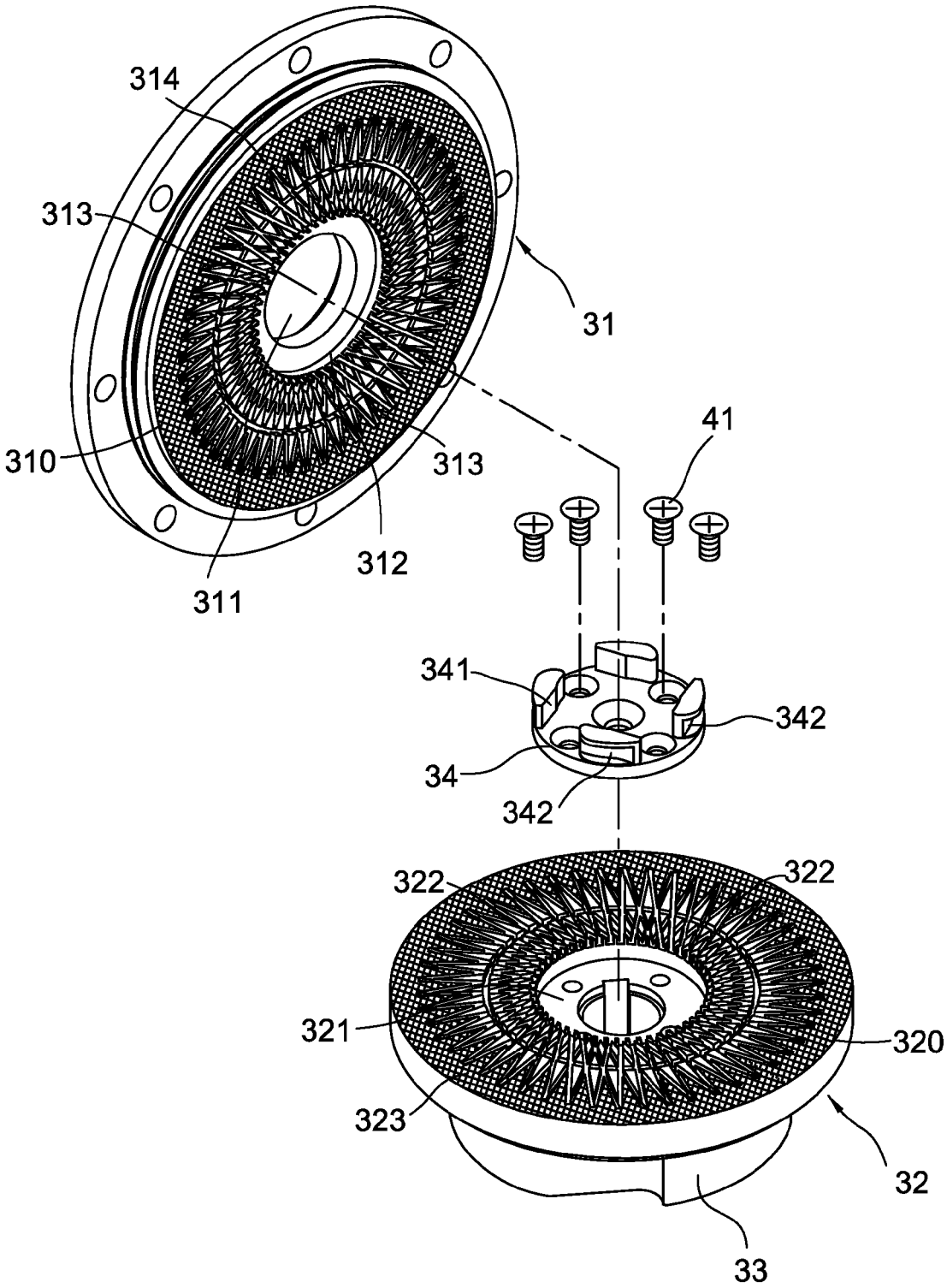
FIG. 2 is an exploded view of the grinding wheel assembly of the invention.
Figure 3:
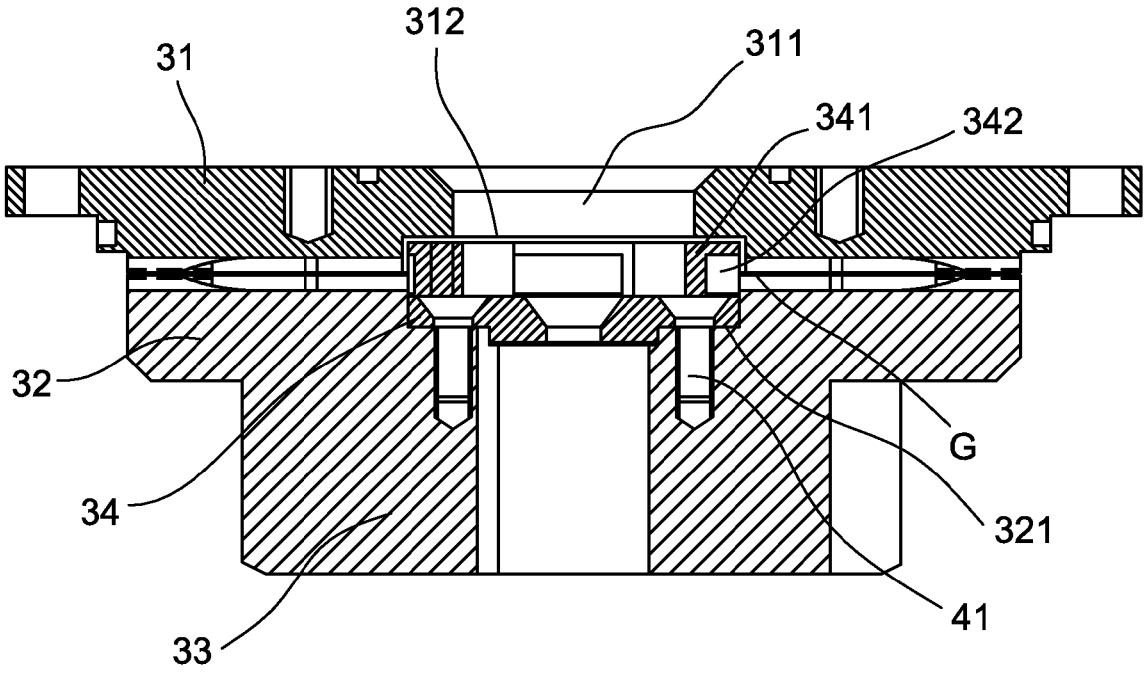
FIG. 3 is a sectional view of the grinding wheel assembly of the invention.
Figure 4:
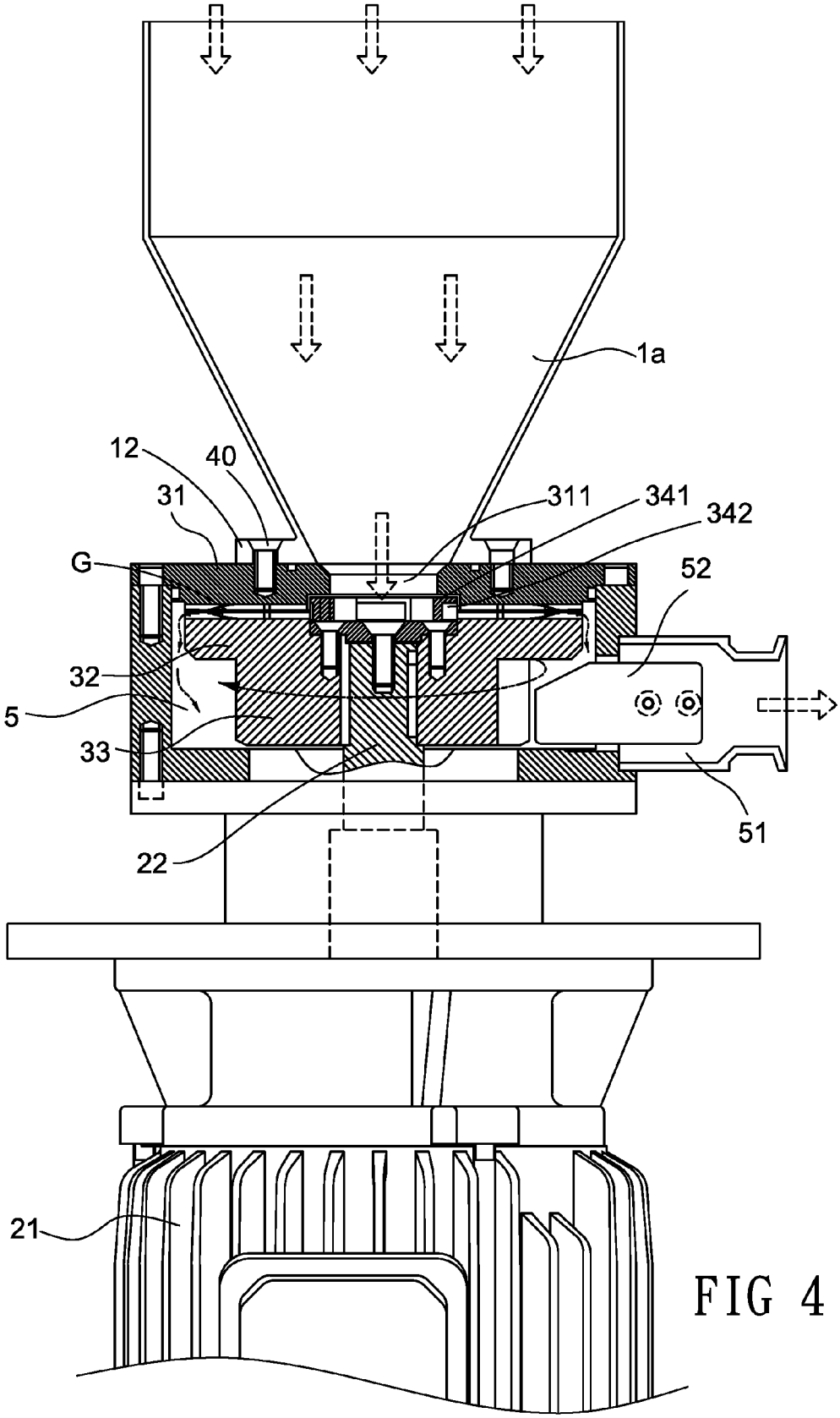
FIG. 4 is a sectional view of the invention.

Please refer to FIGS. 2-4. The grinding wheel assembly 3 is accommodated in a container 5 between the feeder module 1 and the driver module 2. The grinding wheel assembly 3 includes an upper grinding wheel 31 and a lower grinding wheel 32. The upper grinding wheel 31 corresponds to the lower grinding wheel 32 at an interval without contact to form a gap G for allowing material to flow. The upper grinding wheel 31 connects the feeder module 1 and has a feeding hole 311 at the center thereof. The feeding hole 311 communicates with the orifice 11. A periphery of the feeding hole 311 is formed with an annular recession 312. A side 310 of the upper grinding wheel 31 around the feeding hole 311, which faces the lower grinding wheel 32, is formed with multiple rows of knives 313. The knives 313 are directly formed on the side 310. Each row of the knives 313 interdigitates with an adjacent one for cutting the materials. An annular grinding surface 314 is formed around the outermost row of knives 313.

The bottom of the lower grinding wheel 32 is connected with a drain wheel 33 with a waved cylindroid for spoiling and draining the ground materials. The drain wheel 33 is connected to and driven by the spindle 22 of the motor 21. The spindle 22 projects into the inside of the lower grinding wheel 32 for driving the lower grinding wheel 32. The side 320 of the lower grinding wheel 31, which faces the upper grinding wheel 31, is formed with a receiving room 321. The side 320 is formed with multiple rows of knives 322 around the receiving room 321. The knives 322 are directly formed on the side 320. Each row of the knives 322 interdigitates with an adjacent one for cutting the materials. An annular grinding surface 323 is formed around the outermost row of knives 322. Finally, a turntable 34 is received in the receiving room 321 and is fixed by fasteners 41 in the lower grinding wheel 32. An upper end of the turntable 34 is received in the annular recession 312. The turntable 34 is formed with bars 341 in an annular arrangement. A side of each bar 341 is formed with a trough 342 toward the knives 342. An upper end of each bar 341 projects into the annular recession 312. The troughs 342 align with the gap G.

Please refer to FIG. 4. The embodiment is based on a upright type. As shown, when the material to be ground enter the grinding wheel assembly 3 through the feeder module 1 (as the direction of the arrows), the material will be cut by the knives 313, 322 of the upper and lower grinding wheels 31, 32. The lower grinding wheel 32 is driven by the motor 21 so that the material in the gap G flow to the knives 313, 322 and then cut by the knives 313, 322. Meanwhile, the material is flung by the centrifugal force of the grinding wheel assembly 3 to flow outward and is repeatedly cut by the knives 313, 322, so that particles of the ground material can be cut to be a minimum status. Finally, the cut material further flows to the area of the grinding surfaces 314, 323 to be ground so that the material becomes finer. The ground material is introduced into the container 5 (as the direction of the arrows). The drain wheel 33 driven by the motor 21 pushes the material in the container 5 into an outlet 51 on the container 5. Additionally, a spoiler 52 is disposed on the container 5 near the outlet 51. The spoiler 52 help to push the flung material to the outlet so as to accelerate the drain process.

What is claimed is:

1. An emulsification grinder comprising:

a feeder module for loading materials, having an orifice;

a grinding wheel assembly, connected to the feeder module for receiving the material from the orifice, and comprising:

an upper grinding wheel, having a feeding hole at a center thereof, being radially formed with multiple rows of knives, the feeding hole communicating with the orifice, a periphery of the feeding hole being formed with an annular recession;

a lower grinding wheel, corresponding to the upper grinding wheel at an interval, having a receiving room at a center thereof, being radially formed with multiple rows of knives, wherein the knives of the lower grinding wheel corresponds to the knives of the upper grinding wheel in position; and a turntable, received in the receiving room for being driven by the lower grinding wheel, being formed with a plurality of bars in an annular arrangement, each of the bars being formed with a trough facing the knives, upper portions of the bars projecting into the annular recession, and the troughs aligning with a gap between the upper and lower grinding wheels;

a driver module, connecting the lower grinding wheel for driving the lower grinding wheel to rotate; and a material channel, disposed between the feeder module and the driver module, and having an outlet.

2. The emulsification grinder of claim 1, wherein the driver module comprises a motor with a spindle, the spindle passes through the grinding wheel assembly.

3. The emulsification grinder of claim 1, wherein the lower grinding wheel is connected with a drain wheel with a waved cylindroid.

4. The emulsification grinder of claim 1, wherein a spoiler is disposed on the container near the outlet.

5. The emulsification grinder of claim 1, wherein each row of the knives of the upper and lower grinding wheels interdigitates with an adjacent one.

6. The emulsification grinder of claim 1, wherein an annular grinding surface is formed around the outermost row of knives of each grinding wheel.

7. The emulsification grinder of claim 1, wherein the knives are directly formed on the upper and lower grinding wheels.

* * * * *